United States Patent [19]

Gardner

[11] 4,310,760

[45] Jan. 12, 1982

[54] OPTICAL FUZE WITH IMPROVED RANGE FUNCTION

[75] Inventor: Leland V. Gardner, Buellton, Calif.

[73] Assignee: The United States of America as represented by the Secretary of the Army, Washington, D.C.

[21] Appl. No.: 153,462

[22] Filed: May 27, 1980

[51] Int. Cl.[3] ..... G01J 1/00

[52] U.S. Cl. ..... 250/338; 250/514

[58] Field of Search ..... 250/351, 503, 504, 505, 250/514, 338, 221, 349; 356/4

[56] References Cited

U.S. PATENT DOCUMENTS 3,291,991 12/1966 Welti ..... 250/351

3,512,888 5/1970 Humphrey ..... 250/221

*Primary Examiner*—Bruce C. Anderson

*Attorney, Agent, or Firm*—Nathan Edelberg; Robert P. Gibson; Saul Elbaum

[57] ABSTRACT

An optical proximity fuze is disclosed which has an improved response at close range with respect to a target. The fuze comprises a source of infrared radiation or visible light which is projected toward the target, and a receiver or detector which responds to radiation reflected from the target. An opaque field stop in front of the detector comprises multiple apertures for permitting only selected portions of the reflected radiation to reach the detector. The use of multiple apertures, rather than a singular large aperture, improves short range response of the fuze without increasing sensitivity of the fuze to aerosols.

5 Claims, 6 Drawing Figures

OPTICAL FUZE WITH IMPROVED RANGE FUNCTION

RIGHTS OF THE GOVERNMENT

The invention described herein may be manufactured, used and licensed by or for the United States Government for governmental purposes without the payment to me of any royalty thereon.

BACKGROUND OF THE INVENTION

An optical proximity fuze is a device associated with an explosive projectile which is capable of detonating the projectile when it is in proximity to a target. The fuze generally comprises a source of radiation which directs a narrow beam of radiation toward a target, and a receiver or detector which responds to radiation reflected by the target back to the fuze. The detector provides an output signal in response to the radiation incident thereto. When this output signal reaches a threshold level, the detonator may be activated using such signal.

Due to physical and optical limitations, as will be discussed more fully below, radiation sufficient to generate an output signal at the detector above the level needed to detonate the explosive is incident to the detector only within a relatively narrow range of distances to the target. In most instances, the range in which the fuze will respond to incident radiation is deliberately narrowed so as to desensitize the optical fuze to aerosols, such as fog or haze. If the fuze is not desensitized, these aerosols may provide spurious reflective signals tending to activate the fuze at a time when it is not desirable to do so.

A common method utilized to desensitize the fuze to aerosols comprises placing a field stop, or opaque mask, in front of the detector. An aperture in the field stop is selectively positioned so as to allow only a particular portion of the reflected radiation to reach the detector. This permits the fuze to function at a selected range while preventing spurious short range reflections from aerosols from reaching the detector. While this is a desirable result, it is accompanied by the undesirable effect that the fuze is rendered non-responsive to reflections of radiation from the desired target at close range. Merely enlarging the aperature would render the fuze responsive to the target at close range, but would again make it sensitive to the spurious reflections from the aerosols.

Accordingly, it is an object of this invention to provide means to overcome the disadvantages associated with the prior art devices described above.

It is an object of this invention to improve and enlarge the range function of optical fuzes without making the fuzes unduly sensitive to air-borne particles and aerosols.

It is an object of this invention to provide means to shape the range response function of an optical fuze in any manner deemed to be desirable.

SUMMARY OF THE INVENTION

An optical fuze designed in accordance with the present invention comprises a source directing radiation outwardly from the fuze toward a target. This may be a source of either infrared radiation or of visible light. Radiation or light reflected from the target is received by a detector in the fuze. An opaque field stop is placed in front of the detector in the path of the reflected light.

Multiple distinct apertures are provided in the field stop to allow portions of the reflected light to reach the detector when the fuze is at various positions with respect to the target. The use of multiple apertures, rather than a single enlarged aperture, allows the fuze to respond to reflected light over a broader range of distances to the target without responding to erratic signals resulting from reflections by aerosols in the path of the projectile.

DESCRIPTION OF A PREFERRED EMBODIMENT

Figure 1:
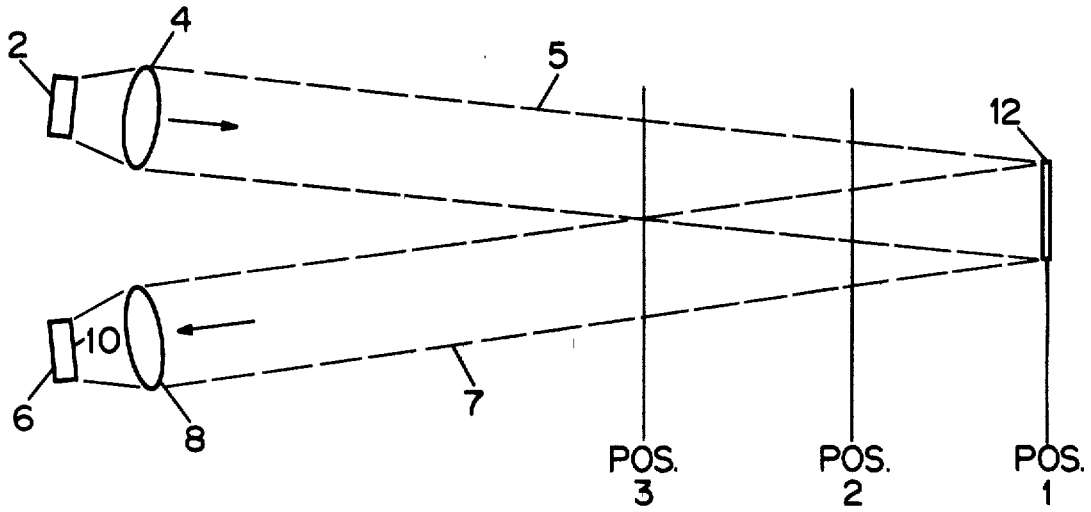
FIG. 1 schematically illustrates the structure and function of a preferred embodiment of the present invention.

Referring to FIG. 1, a source of radiation 2 directs the radiation through a focusing lens 4 forming a beam of radiation 5 which is directed toward target 12. For the sake of the present discussion, the radiation source 2 will be considered as a source of visible light, although it may also comprise a source of infrared radiation. The light is reflected from the target in the form of beam 7, and is directed through focusing lens 8 to detector 6. The detector may comprise a diode or similar element.

When sufficient reflected light is received by the detector, an output signal generated thereby will actuate the fuze, thereby detonating an associated explosive. The range at which sufficient radiation will be reflected to the fuze is determined by the optical beam width, the position and angular orientation of the radiation source and detector, and the lens size and optical properties. The effective range of response of the fuze may be varied by altering any or all of these parameters.

In order to narrow the effective response range of the fuze, and thereby desensitize the fuze to spurious signals resulting from reflections from aerosols in the path of the projectile, a field stop 10 may be placed in front of the detector. The field stop comprises an opaque shield or mask having an aperture therein. While this effectively desensitizes the fuze, it has the undesirable result of rendering the fuze insensitive to light reflected from the target when the target is outside of a relatively narrow range of distances from the fuze.

Figure 2A:
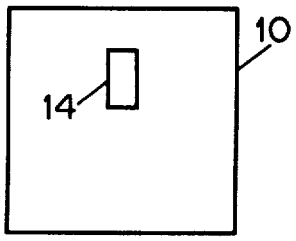
FIG. 2A PRIOR ART
FIG. 2 illustrates an opaque field stop which is associated with an optical fuze of the prior art.
FIG. 2B shows the manner in which the field stop of FIG. 2A interacts with the reflected radiation, in order to actuate the fuze.

FIG. 2A illustrates a field stop commonly used in prior art optical fuzes. The field stop 10 comprises an aperture 14 therein. Light incident to the aperture will reach the detector, while the remaining portion of the reflected light will be blocked by the field stop.

Figure 2B:
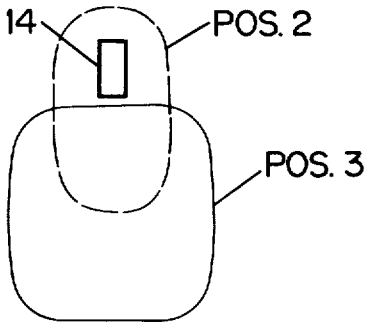
FIG. 2B PRIOR ART

The manner in which the field stop affects the response range of the fuze will be discussed with reference to FIG. 1 and FIG. 2B. When the target is in position indicated as position 1 in FIG. 1 with respect to the fuze, the reflected light will be focused precisely on the aperture 14 in the field stop. This will provide maximum response of the detector. As the projectile and fuze move closer to the target, so that the target is in position 2 relative to the fuze, the reflected beam incident to the field stop comprises a blur as indicated by dashed lines in FIG. 2B. A portion of this blur is incident to the aperture 14, and the detector will therefore respond to the reflected light. As the fuze moves closer to the target, so that the target is in position 3 with respect to the fuze, the blur which is incident to the field stop moves to a position which does not permit any of the reflected beam to pass through the aperture 14. Therefore, the fuze will not respond to reflected light when the target is at position 3 or closer to the fuze.

Figure 3A:
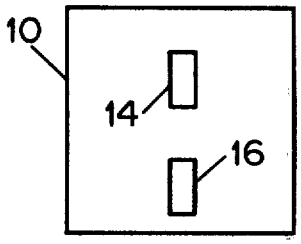
FIG. 3A illustrates the field stop of the optical fuze of the present invention.

FIG. 3A illustrates the improved field stop associated with the optical fuze of the present invention. In addition to the aperture 14, the field stop 10 comprises at least one auxiliary aperture 16.

Figure 3B:
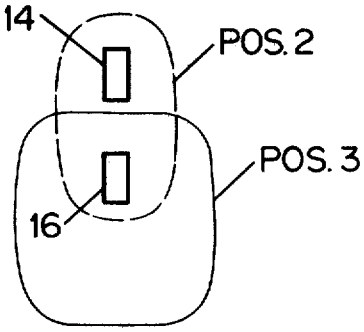
FIG. 3B illustrates the manner in which the field stop of the present invention cooperates with the reflected radiation beam in order to actuate the fuze.

FIG. 3B illustrates the manner in which the field stop of the present invention results in an improved response range. Again, when the target is in position 1 with respect to the fuze, the reflected beam will be focused precisely on aperture 14, thereby actuating the fuze. When the target is in position 2 with respect to the fuze, the blur indicated by dashed lines in FIG. 3B will also actuate the fuze, as previously described with respect to FIG. 2B. When the target is in position 3 with respect to the fuze, the blur, shown in solid lines in FIG. 3B, will move to a position on the field stop which does not coincide with any portion of aperture 14. However, at least a portion of the blur will be coincident with the auxiliary aperture 16, thereby permitting the detector to receive enough incident radiation to activate the detonator.

The separate and distinct apertures of the present invention represent an improvement over merely enlarging the single aperture 14 of the prior art device. If the single aperture was merely enlarged, the fuze would be sensitive to random and spurious signals resulting from reflections of the light beam from air-borne particles and aerosols such as fog or haze. The multiple apertures of the present invention are not sensitive to these random signals, since only a relatively small portion of the total intensity of these random signals will be allowed to penetrate the field stop and reach the detector. The relatively more intense reflected signal from the target will, on the other hand, provide sufficient intensity through any one of the distinct apertures to actuate the receiver, thereby activating the detonator of the fuze.

The dimensions of the apertures 14 and 16 are generally within the range of 0.001—0.010 inches, and may readily be altered to enlarge or decrease the range of response of the optical fuze. It is also possible to provide more than two apertures in the field stop in order to further enlarge the effective response range of the fuze of the present invention.

Figure 4:
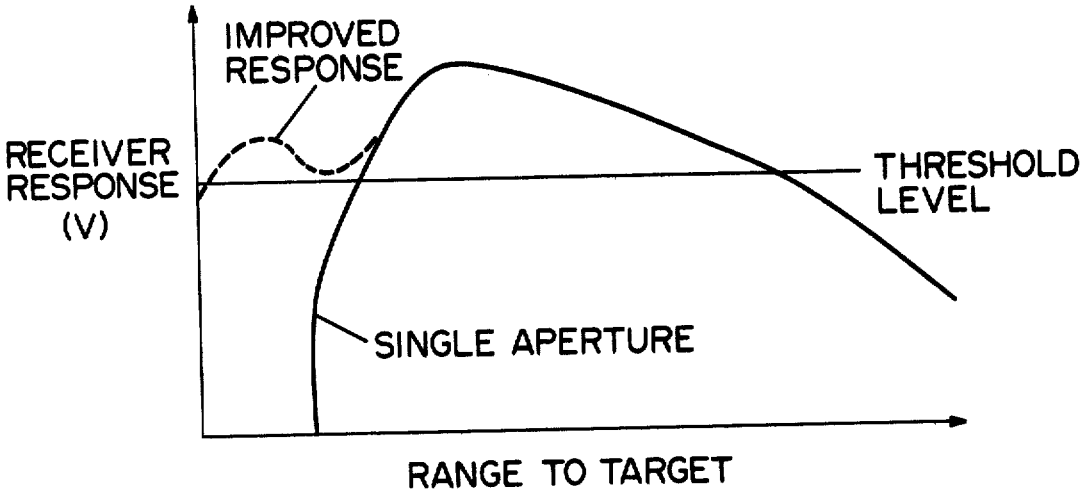
FIG. 4 graphically illustrates the receiver or detector response of the prior art device and the improved response of the device of the present invention.

FIG. 4 illustrates the manner in which an optical fuze responds to reflected light at various distances to the target. The solid line curve represents the response of the detector or receiver when a single apertured field stop, as shown in FIG. 2A, is utilized. It is evident that at close range (position 3, or closer, as illustrated in FIG. 1) the response of the prior art device rapidly decreases to zero. The dashed curve represents the improved and increased response in this range provided by the auxiliary aperture of the present invention. This enables the optical fuze to produce an output signal above the threshold level over a greater range of distances to the target. The threshold level is the minimum required to actuate the detonator of the projectile. Additional auxiliary apertures in the field stop of the present invention would result in a response curve exhibiting additional peaks in receiver output.

While the invention has been described with respect to the accompanying drawings, I do not wish to be limited to the details disclosed therein as obvious modifications may be made by one of ordinary skill in the art.

I claim:

1. An optical device comprising:

a source of radiation;

means for directing said radiation in a beam, through a medium, towards a target space;

receiving means for detecting radiation reflected from a target in said target space;

stop means for limiting radiation reflected from aerosols suspended in said medium from reaching said receiving means;

means for controlling the size of said target space wherein said target space is defined by the ranges at which said reflected radiation will pass through two or more aperatures and be received by said receiving means such that said target is detected within a given set of ranges.

2. An optical device as recited in claim 1;

wherein said stop means comprises an opaque mask interposed between said receiving means and said reflected radiation; and wherein said means for controlling the size of said target space comprises two or more apertures in said opaque mask.

3. An optical device as recited in claim 2 wherein the number of said two or more apertures is determined by the size of said target space desired.

4. An optical device as recited in claim 3 wherein said two or more apertures are separated by a predetermined distance.

5. An optical device as recited in claim 4;

wherein said receiving means comprises a detecting diode; and wherein said source of radiation comprises a source of infrared radiation or visible light.

* * * * *